US005531660A

United States Patent [19]

Biese et al.

[11] Patent Number: 5,531,660

[45] Date of Patent: Jul. 2, 1996

[54] BAG FOLDING APPARATUS

[75] Inventors: John R. Biese, Hortonville; Gregory J. Vanden Heuvel, Kaukauna, both of Wis.

[73] Assignee: Reynolds Consumer Products Inc., Appleton, Wis.

[21] Appl. No.: 374,353

[22] Filed: Jan. 18, 1995

[51] Int. Cl.[6] ..... B31B 1/32; B65H 45/12

[52] U.S. Cl. ..... 493/243; 493/250; 493/436; 493/462; 493/442

[58] Field of Search ..... 493/462, 436, 493/359, 356, 194, 195, 196, 235, 231, 243, 250, 247, 246

[56] References Cited

U.S. PATENT DOCUMENTS

| | | | |
|---|---|---|---|
| 1,729,998 | 10/1929 | Deligianes et al. . | |
| 1,739,328 | 12/1929 | Roesen . | |
| 3,313,216 | 4/1967 | Piazze | 493/243 |
| 3,334,551 | 8/1967 | Cawley | 493/247 |
| 3,379,101 | 4/1968 | Piazze | 493/196 |
| 3,671,033 | 6/1972 | Coast | 493/462 |
| 3,918,698 | 11/1975 | Coast | 270/69 |
| 4,114,530 | 9/1978 | Miller | 100/87 |
| 4,180,256 | 12/1979 | Coast | 270/83 |
| 4,183,515 | 1/1980 | Coast | 270/83 |
| 4,245,829 | 1/1981 | Coast | 493/439 |
| 4,487,598 | 12/1984 | McDonald | 493/450 |
| 5,261,985 | 11/1993 | Lin | 493/462 |

*Primary Examiner*—Jack W. Lavinder
*Assistant Examiner*—Darren A. Da
*Attorney, Agent, or Firm*—Alan T. McDonald

[57] ABSTRACT

A bag folding apparatus comprises an in-feed mechanism, a rotatable spindle, a stripper, and a pair of folding nip rollers. The stripper is slidably mounted on the spindle and is movable between a retracted position and a forward position. To fold a bag segment having one or more bags connected by perforations, the in-feed mechanism first feeds the bag segment to the rotatable spindle while the stripper is disposed in the retracted position. Rotation of the spindle causes the bag segment to be wound about the spindle. After the bag segment is wound about the rotating spindle, the stripper is moved from the retracted position to the forward position. Movement of the stripper from the retracted position to the forward position strips the wound bag segment from the spindle. With the spindle positioned adjacent to the pair of nip rollers, the stripped bag segment is fed between the pair of nip rollers. The pair of nip rollers flatten the stripped bag segment so that the bag segment is effectively folded.

20 Claims, 2 Drawing Sheets

BAG FOLDING APPARATUS

FIELD OF THE INVENTION

The present invention generally relates to bag handling machines and methods for handling bags and, more particularly, relates to a bag folding apparatus and method which fold a bag segment by winding the bag segment about a rotating spindle, stripping the wound bag segment from the spindle, and flattening the stripped bag segment.

BACKGROUND OF THE INVENTION

In many consumer packaging applications, a package destined for a consumer is loaded with a limited number of bags to be used with a product accompanying the bags in the package. For example, some meat seasoning packages hold a pair of bags and a pair of packets containing seasoning for such meats as chicken or beef. A consumer places one or more pieces of meat and the seasoning from one of the packets into one of the bags. Next, while holding the bag closed, the consumer shakes the bag until the pieces of meat are coated with the seasoning. Various other types of consumer-destined packages also contain a limited number of bags.

Bag-making machines often generate a series of bags connected to one another by perforations and wound about a dispensing roll. To load a limited number of the bags on the dispensing roll into one of the consumer-destined packages described above, an operator or machine must remove the bags from the dispensing roll by unwinding the dispensing roll and breaking the perforation connecting the unwound bags to the adjacent bag on the roll. Next, the bags removed from the dispensing roll must be properly folded for orderly placement in the consumer-destined package. The foregoing process of removing bags from the dispensing roll and folding the removed bags must be repeated for each consumer-destined package, and this repetitive process is time-consuming and labor intensive.

A need therefore exists for a bag folding apparatus and method which facilitate placement of a limited number of bags in consumer-destined packages.

SUMMARY OF THE INVENTION

In one particular embodiment of the present invention, the bag folding apparatus comprises an in-feed mechanism, a rotatable spindle, a stripper, and a pair of folding nip rollers. The stripper is slidably mounted on the spindle and is movable between a retracted position and a forward position. To fold a bag segment having one or more bags connected by perforations, the in-feed mechanism first feeds the bag segment to the rotatable spindle while the stripper is disposed in the retracted position. Rotation of the spindle causes the bag segment to be wound about the spindle. After the bag segment is wound about the rotating spindle, the stripper is moved from the retracted position to the forward position. Movement of the stripper from the retracted position to the forward position strips the wound bag segment from the spindle. With the spindle positioned adjacent to the pair of nip rollers, the stripped bag segment is fed between the pair of nip rollers. The pair of nip rollers flatten the stripped bag segment so that the bag segment is effectively folded.

The above summary of the present invention is not intended to represent each embodiment, or every aspect, of the present invention. This is the purpose of the figures and the detailed description which follow.

BRIEF DESCRIPTION OF THE DRAWINGS

Other objects and advantages of the invention will become apparent upon reading the following detailed description and upon reference to the drawings in which.

Figure 1:
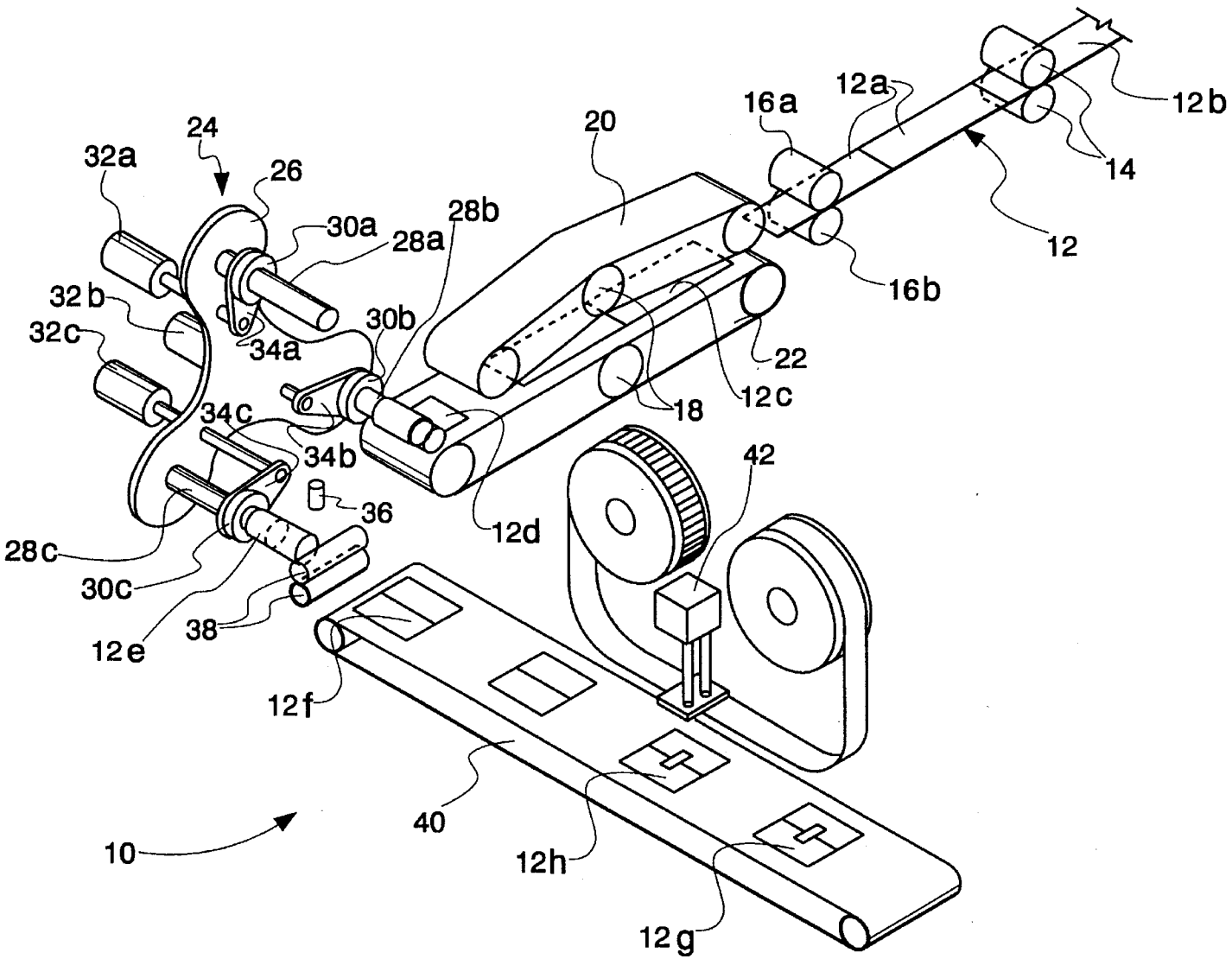
FIG. 1 is a perspective view of a bag folding apparatus embodying the present invention.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DESCRIPTION OF THE PREFERRED EMBODIMENTS

Figure 2:
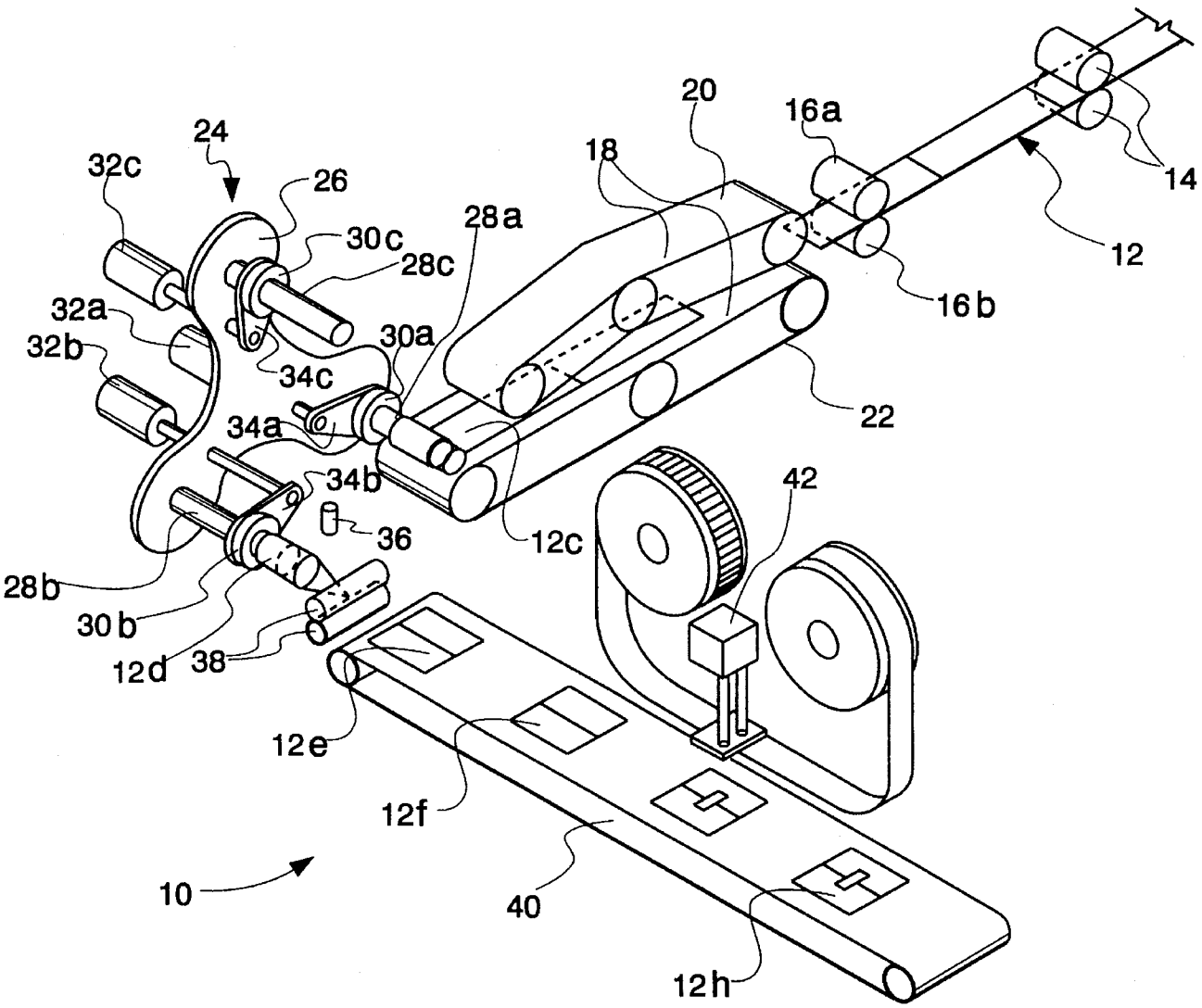
FIG. 2 is another perspective view of the bag folding apparatus in FIG. 1, showing a turret rotated 120 degrees clockwise relative to the position of the turret in FIG. 1.

Turning now to the drawings, FIGS. 1 and 2 illustrate a bag folding apparatus 10 for generating and folding bag segments consisting of a predetermined number of bags. In the preferred embodiment, each bag segment consists of a pair of bags connected along a perforation. Therefore, these bag segments will be referred to herein as "two-bag segments".

In the bag folding apparatus 10, a pair of driven haul-off nip rollers 14 deliver a continuous strip 12 of bags produced by a bag-making machine (not shown) to a pair of driven interrupt rollers 16. The continuous strip 12 of bags passes between the pair of interrupt rollers **16*a*, 16*b*. The upper interrupt roller 16*a* is movable between a separated position and an engaging position using an actuator (not shown). In the separated position, the upper interrupt roller 16*a* is spaced away from the lower interrupt roller 16*b* so that the interrupt rollers 16*a*, 16*b* do not firmly engage the continuous strip 12 of bags. In the engaging position, the upper interrupt roller 16*a* is immediately adjacent the lower interrupt roller 16*b* so that the interrupt rollers 16*a*, 16*b* firmly engage the continuous strip 12 (see FIGS. 1 and 2**).

Referring to FIG. 1, as the leading bag of a two-bag segment **12*a* passes between the interrupt rollers 16*a*, 16*b*, the upper interrupt roller 16*a* is shifted from the separated position to the engaging position. Since the interrupt rollers 16*a*, 16*b* are driven at a slightly faster tangential velocity than the haul-off nip rollers 14, the interrupt rollers 16*a*, 16*b* pull the two-bag segment 12*a* relative to an adjacent upstream two-bag segment 12*b* until the perforations between the trailing edge of the two-bag segment 12*a* and the leading edge of the two-bag segment 12*b* are broken. Once the two-bag segment 12*a* is disconnected from the two-bag segment 12*b*, the upper interrupt roller 16*a* is shifted from the engaging position to the separated position so that the interrupt rollers 16*a*, 16*b* release their grasp upon the two-bag segment 12*a***.

The foregoing process for dividing the continuous strip 12 into disconnected two-bag segments is repeated as each two-bag segment passes between the interrupt rollers **16*a***, 16*b*. For example, as the leading bag of the two-bag segment 12*b* in FIG. 1 passes between the interrupt rollers 16*a*, 16*b*, the upper interrupt roller 16*a* is once again shifted from the separated position to the engaging position. The upper interrupt roller 16*a* remains in this engaging position until the perforations between the two-bag segment 12*b* and an adjacent upstream two-bag segment are broken.

As the interrupt rollers 16*a*, 16*b* break the perforations at the trailing edge of a two-bag segment, the leading edge of the two-bag segment is already passing through an in-feed mechanism 18. The in-feed mechanism 18 includes a pair of conveyor belts 20, 22 positioned directly opposite one another, and the two-bag segments pass through a small gap between the conveyor belts. For example, in FIG. 1 a two-bag segment 12*c* is positioned between the conveyor belts 20, 22, which are advancing the two-bag segment 12*c* downstream. The conveyor speed is substantially the same as the tangential velocity of the haul-off nip rollers 14. To regulate the speeds of the haul-off nip rollers 14, the interrupt rollers 16*a*, 16*b*, and the in-feed mechanism 18, these elements are all coupled to a conventional variable speed drive (not shown).

The in-feed mechanism 18 feeds the two-bag segments to a turret mechanism 24 positioned adjacent the downstream end of the in-feed mechanism 18. The turret mechanism 24 includes a cloverleaf turret 26, three rotatable spindles 28*a–c*, three slidable strippers 30*a–c*, and three slidable rods 32*a–c*. The spindles 28*a–c* are rotatably mounted to respective leaves of the turret 26. The spindles 28*a–c* are spaced equidistant from the center of the turret and from each other. The rods 32*a–c* are slidably mounted to respective leaves of the turret 26 in close proximity to the respective spindles 28*a–c*. The rods 32*a–c* are situated closer to the center of the turret 26 than the spindles 28*a–c*. Moreover, the rods 32*a–c* are spaced equidistant from the center of the turret 26 and from each other.

The donut-shaped strippers 30*a–c* are slidably mounted on the respective spindles 28*a–c* and are movable between a retracted position and a forward position. To slide the strippers 30*a–c* back and forth between the retracted and forward positions, the tips of the slidable rods 32*a–c* are linked to the respective strippers 30*a–c* by respective horseshoe-shaped elements 34*a–c*. In particular, the horseshoe-shaped elements 34*a–c* are retained in grooves formed in the peripheries of the respective strippers 30*a–c*. As a result, oscillation of the rods 32*a–c* between a retracted position (e.g., rods 32*a* and 32*b* in FIG. 1) and a forward position (e.g., rod 32*c* in FIG. 1) causes the respective strippers 30*a–c* to oscillate between their retracted and forward positions on the respective spindles 28*a–c*.

In the preferred embodiment, the turret 26, the spindles 28*a–c*, the rods 32*a–c*, and the horseshoe-shaped elements 34*a–c* are composed of a metal such as steel and are manufactured using conventional machining techniques. The strippers 30*a–c* are preferably composed of a durable plastic such as nylon.

The turret 26 is coupled to a conventional turret stepper motor (not shown), which incrementally rotates the turret 26 clockwise (as viewed in FIGS. 1 and 2) about its center so as to move the spindles 28*a–c* through three stations: a prewinding or waiting station, a winding station, and a stripping station. A spindle at the prewinding station (e.g., spindle 28*a* in FIG. 1 and spindle 28*c* in FIG. 2) is stationary, and its associated stripper and rod are disposed in their retracted positions. In response to actuation of the turret stepper motor, the turret 26 rotates 120 degrees clockwise (as viewed in FIGS. 1 and 2) to move the spindle from the prewinding station to the winding station. FIG. 2 depicts the bag folding apparatus 10 with the turret 26 rotated 120 degrees clockwise relative to its rotational position in FIG. 1.

A spindle at the winding station (e.g., spindle 28*b* in FIG. 1 and spindle 28*a* in FIG. 2) is located slightly above the downstream end of the lower conveyor belt 22 of the in-feed mechanism 18. The stripper and rod associated with the spindle at the winding station are still disposed in their retracted position. At the winding station, the spindle is rotated by a conventional torque motor (not shown). The rotating spindle grips a two-bag segment on the conveyor belt 22 passing beneath the spindle and substantially winds the two-bag segment about spindle. For example, in FIG. 1 a two-bag segment 12*d* is being wound about the spindle 28*b*, while in FIG. 2 the adjacent upstream two-bag segment 12*c* is being wound about the spindle 28*a*. The spindle continues to rotate until only a tail portion of the two-bag segment remains unwound (FIG. 1). In the preferred embodiment, each two-bag segment is approximately thirty inches long; the unwound tail portion of each two-bag segment is approximately six inches long; and the circumference of each spindle is approximately two inches. Therefore, a spindle at the winding station must rotate for approximately twelve revolutions to wind twenty-four inches of a two-bag segment about the spindle. The turret 26 is stationary while the spindle winds the two-bag segment at the winding station.

After a desired length of the two-bag segment is wound about the spindle, the turret 26 is rotated 120 degrees clockwise by the turret stepper motor to move the spindle from the winding station to the stripping station. Movement of the spindle from the winding station to the stripping station releases the connection between the spindle and the torque motor, thereby ceasing rotation of the spindle.

A photoelectric eye 36 is positioned beneath the turret mechanism 24 approximately halfway between the winding station and the stripping station. Moreover, the photoelectric eye 36 is laterally positioned relative to the turret mechanism 24 such that a two-bag segment substantially wound about a spindle passes directly over the photoelectric eye 36 as the spindle moves from the winding station to the stripping station. In response to the trailing edge of the unwound tail portion of the two-bag segment passing over the photoelectric eye 36, the spindle is rotated by a spindle stepper motor (not shown) to wind the unwound tail portion of the two-bag segment about the spindle. Since the unwound tail portion of the two-bag segment is preferably six inches long, the spindle must rotate for nearly three revolutions to wind the tail portion about the spindle. While the tail portion is being wound about the spindle, the turret 26 continues to move the spindle toward the stripping station. In other words, after the tail portion of the two-bag segment passes over the photoelectric eye 36, the spindle is simultaneously rotated and moved toward the stripping station.

Once the two-bag segment is completely wound about the spindle and the spindle reaches the stripping station, the two-bag segment is ready to be stripped off the spindle. To strip the two-bag segment off the spindle, the donut-shaped stripper associated with the spindle is moved from its retracted position to its forward position by moving the rod connected to that stripper from its retracted position to its forward position. The rod is moved from its retracted position to its forward position by means of a conventional actuator (not shown). Since the rod is connected to the stripper by means of the associated horseshoe-shaped element, movement of the rod from its retracted position to its forward position causes corresponding movement of the stripper from its retracted position to its forward position. In FIG. 1, for example, the spindle 28*c* is disposed at the stripping station, and the stripper 30*c* is in the process of stripping a two-bag segment 12*e* off the spindle 28*c*. Both the stripper 30*c* and rod 32*c* in FIG. 1 are disposed somewhere between their retracted positions and their forward positions.

Both the winding station and the stripping station are preferably active at the same time. For example, in FIG. 1 while the two-bag segment 12*e* is being stripped off the spindle 28*c*, the spindle 28*b* is disposed at the winding station and is in the process of winding the two-bag segment 12*d*. The turret 26 is held stationary while the two-bag segment 12*e* is stripped off the spindle 28*c* and the two-bag segment 12*d* is wound about the spindle 28*b*. Similarly, in FIG. 2 while the two-bag segment 12*d* is being stripped off the spindle 28*b*, the spindle 28*a* is disposed at the winding station and is in the process of winding the two-bag segment 12*c*. This concurrent action at the winding station and the stripping station allows the bag folding apparatus 10 to fold 30-inch two-bag segments at a throughput rate as high as approximately 45 two-bag segments per minute.

A pair of driven folding nip rollers 38 are positioned adjacent the tip of a spindle at the stripping station such that the axis of rotation of the spindle passes between the folding nip rollers 38. Moreover, the axes of rotation of the folding nip rollers 38 are perpendicular to the axis of rotation of the spindle. The stripper at the stripping station strips the wound two-bag segment from the spindle, and the stripped two-bag segment is fed between the pair of folding nip rollers 38. The pair of folding nip rollers 38 flatten the stripped two-bag segment so that the two-bag segment is effectively folded.

In the absence of a two-bag segment passing between the folding nip rollers 38, the folding nip rollers 38 preferably abut one another or are very closely spaced from one another. To facilitate acceptance of a stripped two-bag segment between the folding nip rollers 38, one of the folding nip rollers 38 is preferably spring-loaded. In response to the two-bag segment advancing between the folding nip rollers 38, the spring-loaded roller shifts away from the other folding nip roller to permit passage of the two-bag segment between the folding nip rollers 38. While the two-bag segment passes between the folding nip rollers 38, the spring-loaded roller is spring-biased toward the other folding nip roller so as to compress the two-bag segment. This compression assists in flattening the two-bag segment and providing the flattened two-bag segment with sharp creases. In FIG. 1 two-bag segment 12*f* is an example of a two-bag segment which has just been flattened by the folding nip rollers 38.

The folding nip rollers 38 deliver the flattened two-bag segments to an out-feed conveyor belt 40. The out-feed conveyor belt 40 carries the flattened two-bag segments downstream to a tape applicator 42, which is commercially available as Model No. 21145P from Label Air. The tape applicator 42 applies a piece of tape to each flattened two-bag segment to secure the flattened two-bag segments in their folded state. In FIG. 1, for example, the tape applicator 42 has successively applied a piece of tape to the two-bag segments 12*g* and 12*h*. The taped two-bag segments are easily placed in consumer-destined packages such as meat seasoning packages. Accordingly, the bag folding apparatus 10 circumvents the time-consuming and labor intensive prior art process of removing bags from a bag dispensing roll and folding the removed bags.

The timing of the turret mechanism 24 is synchronized with the timing of the in-feed mechanism 18 such that each spindle captures and winds every third two-bag segment delivered by the in-feed mechanism 18 to the winding station. For example, the spindle 28*b* in FIG. 1 is illustrated as winding the two-bag segment 12*d* at the winding station. The turret mechanism 24 is timed so that the spindle 28*b* will be moved to both the stripping and prewinding stations and will then return to the winding station in time to capture and wind the two-bag segment 12*b*. Moreover, the turret mechanism 24 is timed so that the spindle 28*a* will capture and wind the two-bag segment 12*c* (FIG. 2) and the spindle 28*c* will capture and wind the two-bag segment 12*a*.

While the present invention has been described with reference to one or more particular embodiments, those skilled in the art will recognize that many changes may be made thereto without departing from the spirit and scope of the present invention.

For example, the turret mechanism 24 may be modified to include more or less than three spindles with respective strippers, rods, and horseshoe-shaped elements. If the turret mechanism 24 is modified to include only a single spindle, stripper, rod, and horseshoe-shaped element, the in-feed mechanism 18 delivers each two-bag segment to this single spindle. The single spindle may be rotatably mounted on either a stationary turret or a rotating turret.

If the spindle is mounted on a stationary turret, each two-bag segment is wound about the spindle and stripped from the spindle at a combined winding and stripping station. The folding nip rollers are positioned adjacent to this combined winding and stripping station. If, however, the spindle is mounted on a rotating turret, each two-bag segment is first wound about the spindle at a winding station. The turret is then rotated to move the spindle to a stripping station. After stripping the two-bag segment from the spindle, the turret is rotated to return the spindle to the winding station in time to receive the next upstream two-bag segment delivered by the in-feed mechanism.

Each of these embodiments and obvious variations thereof is contemplated as falling within the spirit and scope of the claimed invention, which is set forth in the following claims.

What is claimed is:

1. A bag folding apparatus, comprising:

an in-feed mechanism for conveying a bag segment;

a rotatable spindle, disposed adjacent the in-feed mechanism, for winding the conveyed bag segment;

a stripper slidably mounted on the spindle and movable between a retracted position and a forward position, the stripper being disposed in the retracted position while the spindle winds the bag segment conveyed thereto by the in-feed mechanism, the stripper being moved from the retracted position to the forward position to strip the wound bag segment from the spindle; and a pair of folding nip rollers for receiving the bag segment stripped from the spindle and flattening the stripped bag segment as the bag segment passes between the folding nip rollers, the folding nip rollers being positioned adjacent to a tip of the spindle.

2. The bag folding apparatus of claim 1, wherein the in-feed mechanism includes a pair of closely spaced conveyor belts and the bag segment is conveyed between the conveyor belts.

3. The bag folding apparatus of claim 1, wherein the stripper is donut-shaped.

4. The bag folding apparatus of claim 1, further including a support and wherein the spindle is rotatably mounted to the support, and further including a rod slidably mounted to the support and movable between a retracted position and a forward position, the rod being coupled to the stripper such that movement of the rod between its retracted position and its forward position causes corresponding movement of the stripper between its retracted position and its forward position.

5. The bag folding apparatus of claim 4, further including a horseshoe-shaped element connecting the rod to the stripper.

6. The bag folding apparatus of claim 5, wherein a periphery of the stripper forms a groove retaining the horseshoe-shaped element.

7. The bag folding apparatus of claim 1, wherein the pair of folding nip rollers are perpendicular to the spindle.

8. The bag folding apparatus of claim 7, wherein the pair of folding nip rollers are positioned relative to the spindle such that an axis of rotation of the spindle passes between the folding nip rollers.

9. The bag folding apparatus of claim 8, wherein one of the folding nip rollers is spring-loaded, the one of the folding nip rollers being spring-biased toward the other of the folding nip rollers.

10. A bag folding apparatus including a winding station and a stripping station, comprising:

an in-feed mechanism for successively conveying a plurality of bag segments to the winding station;

a rotatable turret;

a plurality of rotatable spindles rotatably mounted to the turret, each of the spindles being operable to wind an associated bag segment at the winding station and to carry the wound bag segment to the stripping station in response to rotation of the turret, the turret being operable to move the spindles between the winding station and the stripping station;

a plurality of strippers slidably mounted on respective ones of the spindles and movable between a retracted position and a forward position, the strippers being disposed in the retracted position while their respective spindles wind their associated bag segments at the winding station, the strippers being moved from the retracted position to the forward position at the stripping station to strip the wound bag segments from their respective spindles; and a pair of folding nip rollers for successively receiving the bag segments stripped from their respective spindles and flattening the stripped bag segments as the bag segments pass between the folding nip rollers, the folding nip rollers being positioned adjacent to tips of the spindles while the spindles are disposed at the stripping station.

11. The bag folding apparatus of claim 10, wherein one of the spindles is operable to wind its associated bag segment at the winding station while another one of the spindle is having its associated bag segment stripped therefrom by its associated stripper.

12. The bag folding apparatus of claim 10, wherein the strippers are donut-shaped.

13. The bag folding apparatus of claim 10, further including a plurality of rods slidably mounted to the turret and movable between a retracted position and a forward position, the rods being coupled to respective ones of the strippers such that movement of the rods between their retracted positions and their forward positions causes corresponding movement of the respective strippers between their retracted positions and their forward positions.

14. The bag folding apparatus of claim 13, further including a plurality of horseshoe-shaped elements connecting the rods to their respective strippers.

15. The bag folding apparatus of claim 14, wherein peripheries of the strippers form grooves retaining the respective horseshoe-shaped elements.

16. The bag folding apparatus of claim 10, wherein the pair of folding nip rollers are perpendicular to the spindles while the spindles are disposed at the stripping station.

17. The bag folding apparatus of claim 16, wherein the axes of rotation of the spindles at the stripping station pass between the folding nip rollers.

18. A method of folding a bag segment, comprising the steps of:

feeding the bag segment to a spindle having a stripper slidably mounted on the spindle, the stripper being disposed in a retracted position;

winding the bag segment about the spindle by rotating the spindle;

stripping the wound bag segment from the spindle by moving the stripper from the retracted position to a forward position; and feeding the stripped bag segment between a pair of folding nip rollers positioned adjacent the spindle so as to flatten the stripped bag segment.

19. A method of folding first and second bag segments, comprising the steps of:

feeding the first bag segment to a first spindle at a winding station, the first spindle having a first stripper slidably mounted on the first spindle, the first stripper being disposed in a retracted position;

winding the first bag segment about the first spindle at the winding station by rotating the first spindle;

moving the first spindle from the winding station to a stripping station;

stripping the wound first bag segment from the first spindle at the stripping station by moving the first stripper from the retracted position to a forward position;

feeding the second bag segment to a second spindle at the winding station, the second spindle having a second stripper slidably mounted over the second spindle, the second stripper being disposed in a retracted position;

winding the second bag segment about the second spindle at the winding station by rotating the second spindle;

feeding the stripped first bag segment between a pair of folding nip rollers positioned adjacent the first spindle at the stripping station so as to flatten the stripped first bag segment;

moving the second spindle from the winding station to the stripping station;

stripping the wound second bag segment from the second spindle at the stripping station by moving the second stripper from the retracted position to a forward position; and feeding the stripped second bag segment between the pair of folding nip rollers at the stripping station so as to flatten the stripped second bag segment.

20. The method of claim 19, wherein the step of stripping the wound first bag segment and the step of winding the second bag segment are performed at least partially at the same time.

* * * * *